US005666740A

United States Patent [19]

Leinonen et al.

[11] Patent Number: 5,666,740

[45] Date of Patent: Sep. 16, 1997

[54] HOOD FOR A WIRE PART AND FOR A PRESS SECTION

[75] Inventors: Antti Leinonen, Laukaa; Henrik Pettersson, Mynämäki; Risto Salminen, Kaarina; Hannu Niemikko, Nousiainen; Juha Kivimaa, Muurame; Pertti Heikkilä ; Tapio Lento, both of Raisio; Erkki Kiilavuori, Jyväskylä , all of Finland

[73] Assignee: Valmet Corporation, Helsinki, Finland

[21] Appl. No.: 638,442

[22] Filed: Apr. 26, 1996

[51] Int. Cl.[6] ..... F26B 11/02

[52] U.S. Cl. ..... 34/114; 34/116; 34/117

[58] Field of Search ..... 34/114, 115, 116, 34/117, 120, 122, 123

[56] References Cited

U.S. PATENT DOCUMENTS 3,434,224 3/1969 Blomgren et al. ..... 34/114
3,443,325 5/1969 Jones ..... 34/114
4,536,970 8/1985 Eskelinen ..... 34/41

*Primary Examiner*—Henry A. Bennett
*Assistant Examiner*—Dinnatia Doster
*Attorney, Agent, or Firm*—Steinberg, Raskin & Davidson, P.C.

[57] ABSTRACT

A hood for a wire part and/or a press section in a paper/board machine including walls and a ceiling which form a closed hood around the wire part and/or press section, air-conditioning or another air-control system being arranged in connection with the hood. The hood walls have outer and inner walls which define an air duct therebetween for passing a replacement air flow into the interior of the hood, preferably toward a middle area of the paper machine, through openings in the inner wall, the replacement air keeping the interior of the hood substantially dry and clean. The walls of the hood include a vertical side wall at the driving side, which wall is preferably fixed, and a tending-side vertical side wall and a ceiling formed as a single wall which is preferably L-shaped and displaceable. The displaceable hood wall at the tending side has two parts so that the first hood wall is placed by the wire section and the second hood wall is placed by the press section.

14 Claims, 4 Drawing Sheets

HOOD FOR A WIRE PART AND FOR A PRESS SECTION

FIELD OF THE INVENTION

The present invention relates to a hood for a wire part and/or for a press section in a paper/board machine. The hood includes walls and a ceiling which form a closed hood around the wire part and/or the press section. Air-conditioning or air-ventilation devices are arranged in connection with the hood for ventilating the interior of the hood in which the wire part and/or press section is/are situated.

BACKGROUND OF THE INVENTION

It is known in the prior art to place the wire part, the press section, and/or the dryer section of a paper machine inside a hood. The aim of the placement of the wire part in a hood has been in particular to prevent spreading of moisture drops into the machine shall. In the area of the press section, the hood is provided in view of energy economy enabled thereby, and thus there has been an attempt to obtain such energy efficiency as the pressing of the paper web is accomplished more efficiently because the web and the felts that are used are warmer as a result of the placement of the hood. It is a further object of the hood to operate as a noise insulation mechanism and to separate the wire part and the press section from the rest of the machine hall, in which case the hood prevents spreading of moisture into the machine hall. In the dryer section, by means of the placement of a hood in connection therewith, attempts are made in particular to reduce the consumption of energy and to prevent spreading of heat, moisture and noise into the machine hall.

With respect to prior art related to the dryer section and the placement of a hood in connection therewith, reference is made, for example, to the publication Wochenblatt fur Papierfabrikation 23/241992, by F. Sodec, entitled "Neues Haubenkonzept für energiesparende Papiertrocknung". In this publication, an exemplifying embodiment is described of a concept in which, in the dryer section, a hood and an air-conditioning arrangement are employed.

With respect to additional prior art related to the dryer section, reference is made to Finnish Patent 63,980 (which corresponds to U.S. Pat. No. 4,536,970, which is incorporated by reference herein), in which a method is suggested and disclosed for enhancing the air-conditioning in dryer sections provided with a closed hood in paper machines. In this patent, particular emphasis is placed on arranging the air-conditioning, or other air-control system, of the hood so that problems arising from condensation can be prevented.

With respect to hood arrangements related to the press section of a paper machine, reference is made to Finnish Patent 83,551, in which a press section of a paper machine is described in particular a press section in which suction rolls are used. According to FI 83,551, the press section is covered with a hood, whose construction is such that it both raises the temperature of operation of the press section and reduces the noise level in the environment outside the press section to a substantial extent. In the arrangement in accordance with FI 83,551, the hood comprises of displaceable wall and ceiling elements positioned at the tending side and displaceable or fixed wall elements positioned at the driving side. These elements of the hood are made of a sound-insulating material, which is at least partially transparent at the tending side. The description of the inventions in FI 83,551 constitutes the prior art most closely related to the present invention.

OBJECTS AND SUMMARY OF THE INVENTION

Accordingly, it is an object of the present invention to further develop the arrangement described in FI 83,551 while also applying this arrangement to the wire part and while, in particular, paying attention to problems related to the arrangements of supply of air as well as to the construction of the hood elements proper.

It is a further important object of the present invention to arrange a hood so that it does not produce problems during cleaning of equipment situated within the hood.

It is a further object of the present invention to develop the embodiment described in FI 83,551 so that, when necessary, the shifting of the wall constructions can be accomplished easily and in a simple manner.

It is yet another object of the present invention to prevent condensation in the start-up stage and in the initial stages of production of a paper in a paper machine.

It is a still another object of the present invention to provide an arrangement by whose means the hood in the area of the wire and in the area of the press section can be sealed so that the area inside the hood and the area outside the hood, respectively, constitute air-conditioning or air-ventilation units of their own. It is noted that the use of the term "air-conditioning" in this application is to be construed in its broad and natural sense, i.e., something which conditions or affects the properties of air, and is not limited to the commonly used definition involving the application of specifically a cooled flow of air.

In view of achieving the objects stated above, those that will come out later, and others, the arrangement in accordance with the invention is mainly characterized in that the hood walls are comprised of outer walls and inner walls facing the interior of the hood, so that between the outer and inner walls, there is an air duct or passage through which a flow of replacement air flows into the interior of the hood. Preferably, the replacement air is directed through the inner wall toward a substantial middle area of the paper machine through openings arranged in the inner wall. The replacement air serves to keep the interior of the hood substantially dry and clean.

According to the invention, the replacement air is supplied into the hood of the wire part and/or the press section from the wall and ceiling elements, the elements being heated as the air flows in the frame space in the space between the two walls of the wall or ceiling element. The replacement air, which is ideally dry, is discharged, for example, through slots all over the area of the wall and ceiling faces into the interior of the hood. Then, the walls and the ceiling remain clean and dry as the elements are warm, in which case there is no risk of condensation on the wall surfaces contacting the interior of the hood which would be caused by a difference in temperature between the interior of the hood and the surface temperature of the walls defining the hood. In the arrangement in accordance with the invention, the necessary replacement air is brought to the wire part and to the press section through slots or a perforated face provided on the wall elements of the hood.

In a preferred embodiment of the arrangement in accordance with the invention, the replacement air is directed to both sides of the paper/board machine, viz., to the tending side and to the driving side, as well as to the top side and to the tending platform. The removal of air is carried out through the exhaust arrangements provided in the process, in which case, in the interior of the hood, the air flows out of the space of the tending platforms and from elsewhere in the environment of the machine to the middle of the machine, and then the air in the working area remains dryer and the inner faces of the hood remain clean. Instead, the warm and humid circulation air is brought to the area of the wire and the web, for the circulation air must be as humid as possible in order that the temperatures of the web and the wire should not become lower by the effect of evaporation. In the arrangement, preferably a sufficiently warm circulation air is employed, and at the same time evaporation as well as lowering of the temperatures of the web and the wires are prevented. If necessary, the temperature in the space inside the hood can be raised. The circulation air constitutes a part of the exhaust air of the hood, or it consists of exhaust air from other processes of the paper machine.

The arrangement in accordance with the invention is suitable for use in different paper machines and also in tissue and TAD machines. (In TAD machines, there is no press section proper, for which reason intensified draining in the wire part, of course, provides a remarkably increased rate of production.)

In the arrangement, preferably displaceable hood elements are used. In accordance with an exemplifying embodiment of the invention, the displaceable parts of the hood move preferably in two opposite directions: the displaceable hood element of the wire part being arranged to move toward the wet end of the paper machine and the displaceable hood element of the press section being arranged to move toward the dry end of the paper machine, for example, onto or over the hood of the dryer section. In the paper machine, at the driving side, preferably at least one stationary hood wall is used, because the drive gear placed at the driving side requires an abundance of lead-in holes from the interior of the hood to the machine hall. For example, on the wall at the driving side and on the floor of the machine plane at the tending side, rails are provided along which the hood is displaced. The hood element is provided with necessary gates etc., doors and windows. For example, in the hood element of the press section, there is a gate for replacement of the wire and/or felt, which gate is, in the open portion, placed in the same location as in the hood of the dryer section.

In the arrangement in accordance with the invention, a flow of replacement air is brought through the walls defining the hood, and the flow is guided toward the paper machine. The frame beams in the wet end of the paper machine can be used for the supply of circulation or replacement air. According to a preferred feature of the invention, the hood is arranged to be sealed in relation to the rest of the machine hall, in which case the wire part and the press section as well as the machine hall have separate air spaces. As a result, the requirement of air-conditioning in the hall is reduced because the heat and moisture load in the machine hall becomes lower. The hood also lowers the noise level in the machine hall at the wet end of the paper machine, because, according to the invention, the elements have been constructed so that the air space between the walls in the element, together with the walls, forms an efficient sound insulation mechanism, i.e., the space between the inner and outer walls of the hood walls serve to reduce the sound penetration therethrough. By means of the hood arrangement in accordance with the invention, considerable economies of energy are obtained, i.e., increased energy efficiency. The economies of energy can be enhanced further by means of the recovery of heat connected with the hood arrangement, which recovery becomes possible because of the increased humidity and raised temperature of the exhaust air.

According to the invention, the supply of air has been arranged so that the hood construction can be kept sealed. Moreover, in the hood construction, consideration has been given to various operations of servicing, drive and tending and, thus, to accessibility of the wire part and of the press section.

Thus, in its most basic embodiment, the hood for a wire part and/or a press section in a paper/board machine in accordance with the invention comprises enclosure means arranged around the wire part and/or the press section for defining a closed interior of the hood and first ventilation means extending into the interior of the hood through the enclosure means for ventilating the interior of the hood. The enclosure means comprise at least one component, such as a wall or ceiling component, having an outer wall and an opposed inner wall facing the interior of the hood, the outer wall being spaced from the inner wall to form an air duct therebetween. The inner wall has openings extending between the air duct and the interior of the hood. Second ventilation means are arranged for directing a replacement air flow into and through the air duct formed between the outer and inner walls such that the replacement air flows into the interior of the hood through the openings in the inner wall. The component(s) of the enclosure means may comprise a plurality of discrete material layers to improve the sound insulation capacity of the component(s) of the enclosure means.

In the following, the invention will be described in more detail with reference to the figures in the accompanying drawing. However, the invention is not strictly confined to the details of the illustrated embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
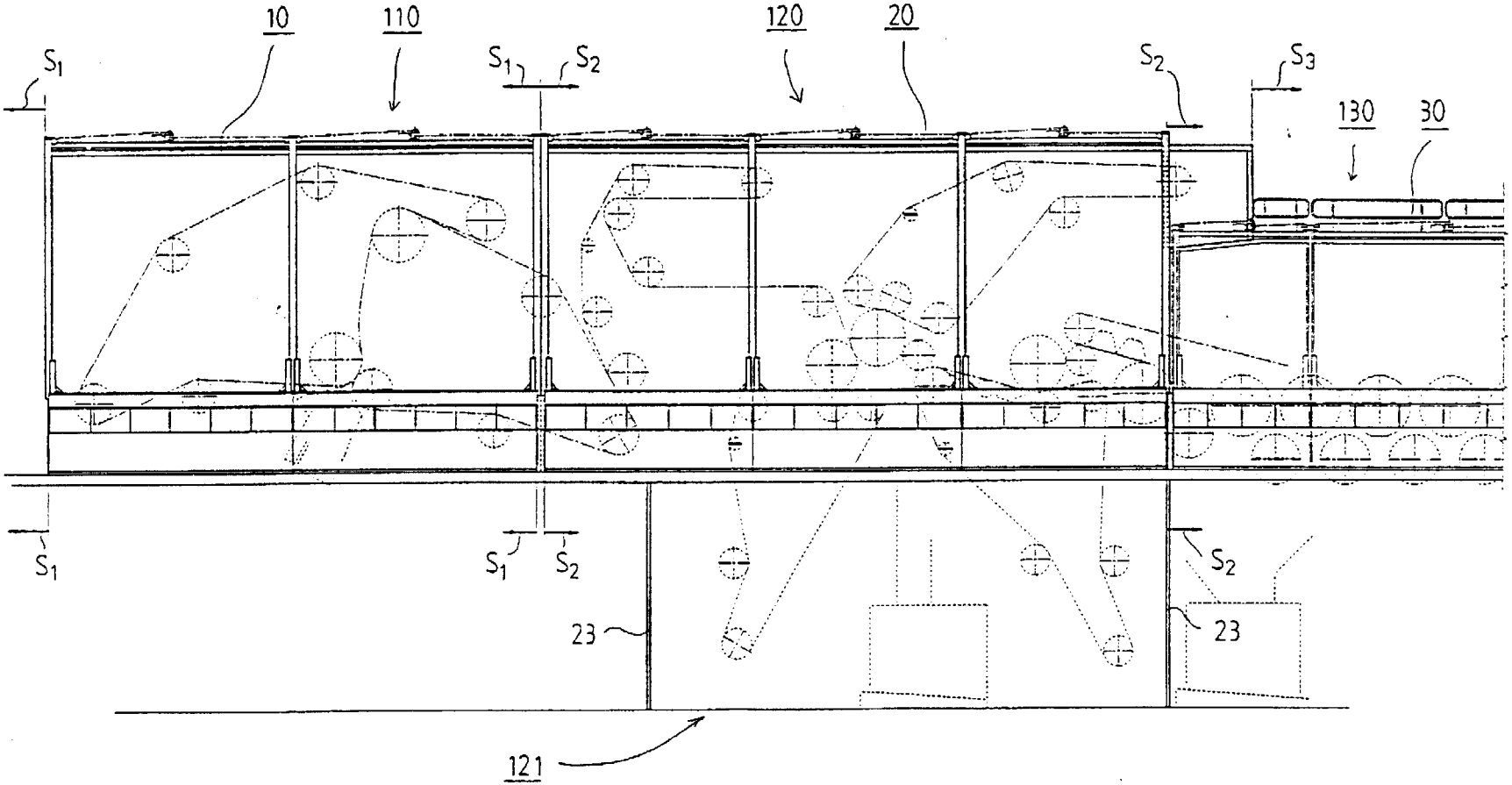
FIG. 1 is a schematic side view of the wire part and the press section of a paper machine viewed from the tending side.

Referring to the accompanying drawings wherein the same reference numerals refer to the same or similar elements, FIG. 1 is a schematic illustration of a wire part 110 and a press section 120 of a paper machine viewed from the tending side. The wire part 110 is provided with a tending-side hood wall 10, which can be shifted in the direction indicated by the arrows $S_1$ and thus in the direction of the wet end of the paper machine. The press section 120 is also provided with a hood wall 20 which can be shifted in the direction indicated by the arrows $S_2$ in the direction of the dry end of the paper machine. The hood construction 10,20 is preferably L-shaped and can be shifted along rails arranged, for example, on the wall at the driving side and on the floor at the tending side. Thus, the hood walls 10,20 forms the ceiling and the vertical wall at the tending side as well as the necessary end walls of the entire hood assembly. The portions of the press section 120 placed in a basement space 121 below the tending platform are placed inside hood walls 23. The hood wall 20 of the press section 120 is shifted in the direction of the arrow $S_2$, for example, onto a hood 30 of a dryer section 130 following the press section 120. The hood walls 10,20 at the tending side can be provided with transparent portions so as to maintain a sight connection with the paper machine, and with portions that can be opened and closed for servicing, such as lift gates, side doors, or equivalent.

Figure 2:
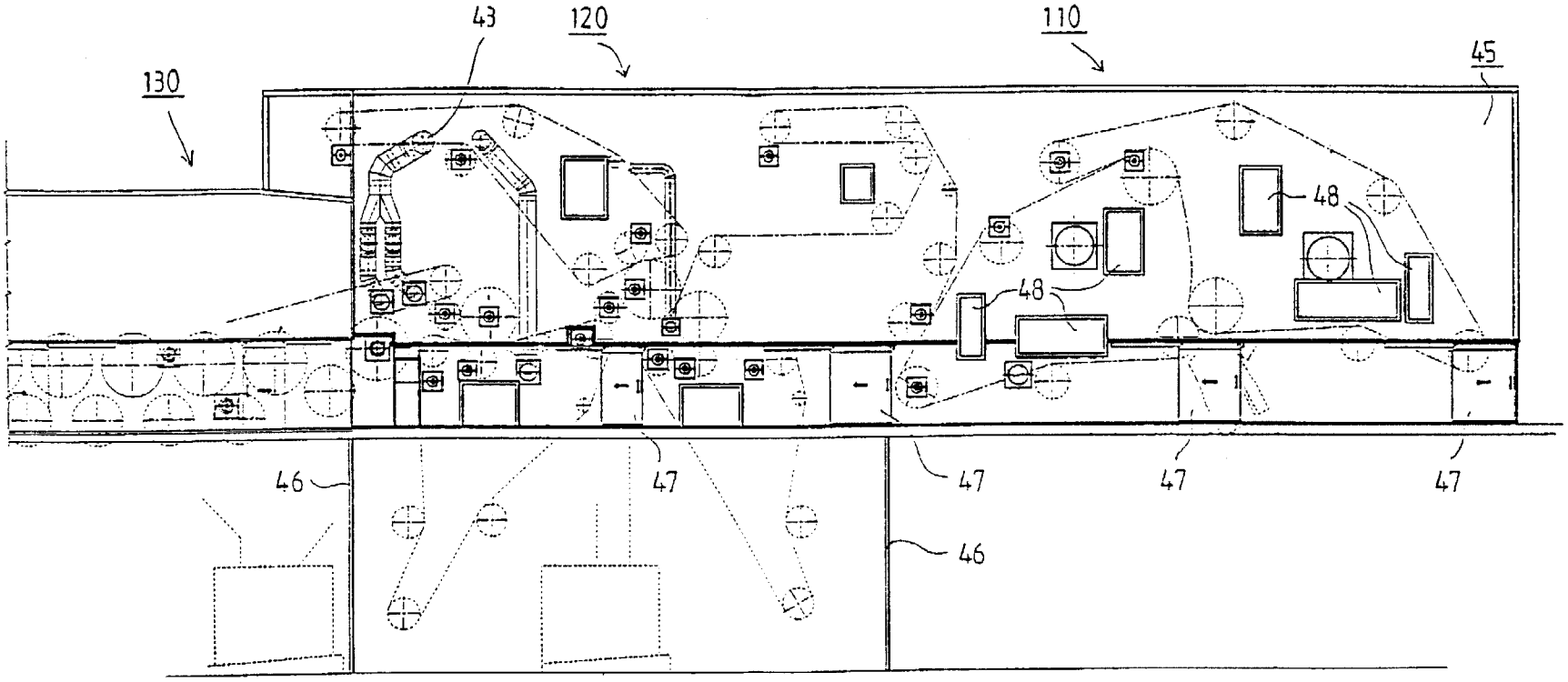
FIG. 2 is a schematic illustration of the wire part and the press section of the paper machine viewed from the driving side.
Figure 3:
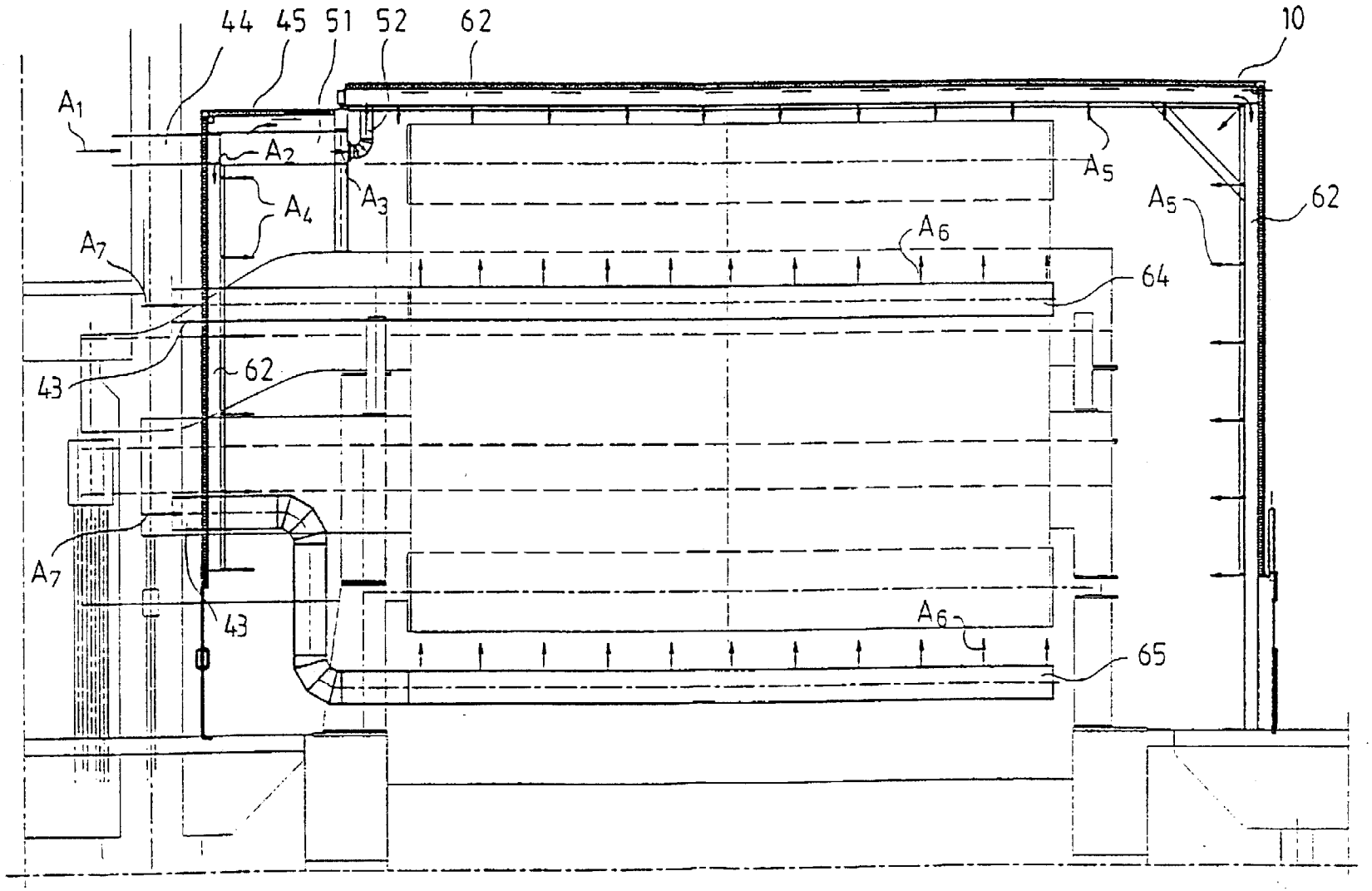
FIG. 3 is a schematic sectional view of the wet end of the paper machine.

FIG. 2 is a schematic illustration of the hood construction on the wire part and on the press section of the paper machine viewed from the driving side. At the driving side, a hood wall 45 is continuous between the wire part and the press section and preferably mounted stationarily in its position. At the driving side, the hood wall 45 is provided with openable doors 47. Through the hood wall 45, lead-in openings are provided for the drives, frame beams, air ducts, and other equipment needed for the wire part or press section. The basement space is also confined by walls 46. In accordance with the invention, replacement air, which is preferably dry, is passed into interior cavities or spaces defined within one or more of the hood walls 10,20,45 through ventilation means such as a series of flow ducts 44,51,52 which are preferably connected to the hood wall 45 at the driving side (FIG. 3). Air is also passed through ducts 43 directly into the interior of the hood.

FIG. 3 is a schematic sectional view in the direction of width of the machine at the wire part 110, and the illustration shows the stationary hood wall 45 at the driving side as well as the L-shaped displaceable hood wall 10 formed at the tending side, wall 10 thus forming the ceiling and the other side wall of the hood. The replacement air introduced into the interior of the hood through the hood is passed from the duct 44 as an air flow $A_1$, and it is distributed into the ducts 51,62 as air flows $A_2$ and $A_3$, of which the air flow $A_2$ is blown into the space in the interior of the hood as the flows $A_4$ through the duct 62 formed in the interior of the fixed hood wall 45. The flow $A_3$ is passed from the duct 51 into a duct 52 and further into the duct 62 placed in the interior of the L-shaped hood wall 10, from which it is passed through the blow openings as air flows $A_5$. Circulation flow in the interior of the hood is introduced as inlet flows $A_7$ into the interior of the hood through ventilation means such as ducts 64 and 65, extending in a direction across the width of the wire part or press section, as flows $A_6$.

The hood is sealed in relation to the rest of the machine hall, and the displaceable hood walls 10,20 are sealed in relation to the stationary hood wall 45 and to the floor of the machine hall, for example, by means of brush seals or labyrinth seals (not shown in the illustrations). The duct 52 has been made at least partially resilient so that displacement of the hood wall 20 relative to the hood wall 10 does not create problems. The temperature of the replacement air is from about 40° C. to about 90° C., preferably from about 60° C. to about 70° C., and its humidity is from about 5 to about 30 grams of $H_2O$ per kilogram of dry air, preferably from about 10 to about 20 grams of $H_2O$ per kilogram of dry air. The temperature of the circulation air is from about 40° C. to about 70° C., preferably from about 45° C. to about 55° C., and its humidity is from about 50 to about 200 grams of $H_2O$ per kilogram of dry air, preferably in a range from about 65 to about 115 grams of $H_2O$ per kilogram of dry air.

Figure 4A:
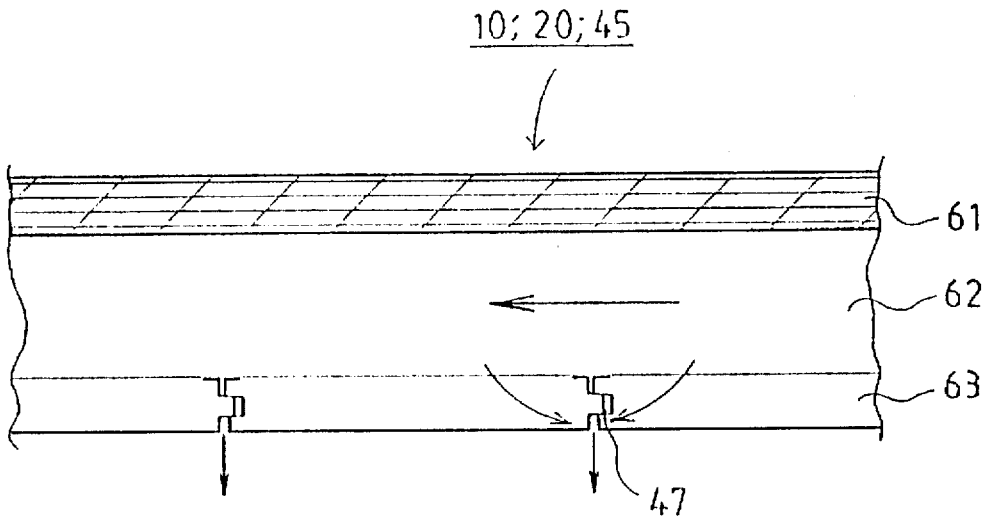
FIGS. 4A and 4B are schematic illustrations in part of the construction of a wall element of the hood in accordance with the invention.
Figure 4B:
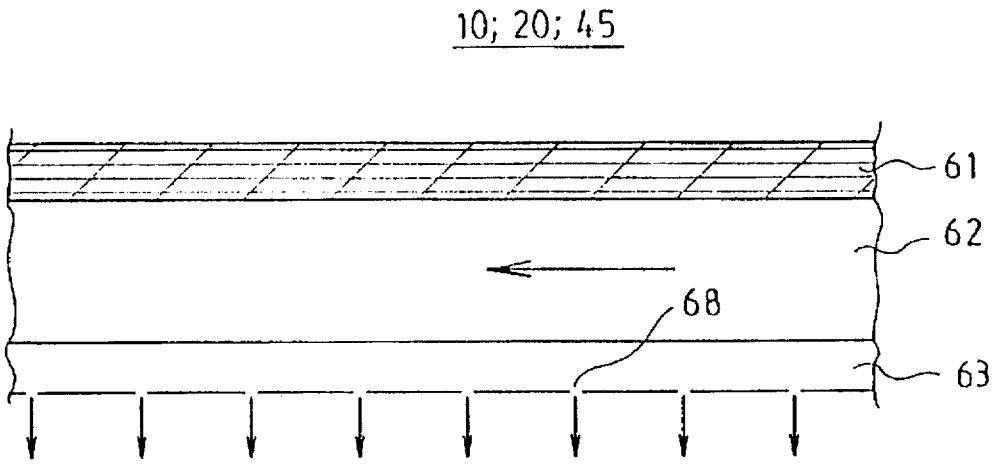

FIG. 4A is a schematic enlarged illustration in part of an exemplifying embodiment of the construction of the hood wall 10,20,45 in accordance with the invention. In the hood wall 10,20,45, there is a continuous sound-insulating and noise-insulating outer wall 61 placed at a side oriented toward the machine hall, i.e., the ambient atmosphere, and an inner wall 63 placed inside the hood and oriented toward the interior of the hood. An air duct 62 is formed between walls 61,63 into and through which the replacement air is passed. The replacement air is removed from the air duct 62 through slots formed at joints 67 provided in the inner wall 63, or other apertures in the inner wall 63. In the exemplifying embodiment of FIG. 4B, separate blow openings 68 are made in the inner wall 63, through which openings 68 the air is blown into the interior of the hood. The exhaust air is evacuated from the interior of the hood through the exhausts provided in the process of the paper machine.

The inside face of the inner wall 63 of the hood elements 10,20,45, i.e., inner with respect to the interior of the hood, is made of a sheet material, preferably a stainless material, which permits easy cleaning and high strength of the wall 63 face. The lower face of the ceiling, i.e., the outer face of the inner wall 63 exposed to the interior of the hood, can be coated with a suitable material, for example Teflon, to improve the cleanliness. Since the air flowing in the interior of the hood walls 10,20,45 is preferably heated, condensed water is not formed on the faces of these walls interposed between the air ducts 62 and the interior of the hood. The outer wall 61 of the wall construction is made of an insulating material and a sheet material, preferably glass wool and aluminum. The thickness of the entire wall construction is from about 300 mm to about 500 mm. Besides the preferred exemplifying embodiment described above, the hood walls can also be collapsible or have a bellows construction or equivalent, provided they include ducts for the passage of air and in flow communication with apertures through which such air can be directed into the interior of the hood. Hoods made for small paper machines may comprise ceiling and wall constructions that can be lifted off.

The examples provided above are not meant to be exclusive. Many other variations of the present invention would be obvious to those skilled in the art, and are contemplated to be within the scope of the appended claims.

We claim:

1. A hood for a wire part, a press section or a press and wire section in a paper/board machine, comprising enclosure means arranged around the wire part, a press section or a press and wire section for defining a closed interior of the hood, said enclosure means comprising at least one component having an outer wall and an opposed inner wall facing the interior of the hood, said outer wall being spaced from said inner wall to form an air duct therebetween, said inner wall having openings extending between said air duct and the interior of the hood, first ventilation means extending into the interior of the hood through said enclosure means for ventilating the interior of the hood, and second ventilation means for directing a replacement air flow into and through said air duct formed between said outer and inner walls such that the replacement air flows into the interior of the hood through said openings in said inner wall.

2. The hood of claim 1, wherein said openings are arranged in said inner wall such that the replacement air flow is directed toward a middle region of the machine.

3. The hood of claim 1, wherein the machine has a tending side and a driving side, said enclosure means comprising a first vertical side wall arranged at the driving side, a second vertical side wall arranged at the tending side and a ceiling extending between said first and second vertical side walls, said ceiling being formed integral with said second vertical side wall.

4. The hood of claim 3, wherein said second vertical wall comprises a first wall portion placed around the wire part and a second wall portion placed around the press section, said first and second wall portions being separately displaceable in opposite directions from one another.

5. The hood of claim 1, wherein the replacement air is dry air such that when said second ventilation means pass the replacement air flow through said air duct between said outer and inner walls, the hood is maintained warm thereby preventing a substantial temperature difference between the replacement air in said air duct and air in the interior of the hood.

6. The hood of claim 1, wherein said first ventilation means are arranged to pass a circulation air flow having a set temperature and humidity based on the temperature of a paper web running in the machine.

7. The hood of claim 1, wherein said enclosure means comprise hood walls for surrounding a basement space of the paper/board machine to enclose parts of the wire part, a press section or a press and wire section placed in the basement space.

8. The hood of claim 1, wherein an inner face of said inner wall is made of a stainless sheet material.

9. The hood of claim 1, wherein said outer wall is made of an insulating material and a sheet material.

10. The hood of claim 1, wherein said outer wall is made of glass wool and aluminum.

11. The hood of claim 1, wherein said at least one component of said enclosure means comprises a plurality of discrete material layers to improve the sound insulation capacity of said at least one component of said enclosure means.

12. The hood of claim 1, wherein the hood is sealed in relation to the rest of a machine hall in which the machine is situated by at least one of a brush seal and a labyrinth seal.

13. The hood of claim 1, wherein said enclosure means comprises hood walls, at least one of said hood walls including openable doors for servicing or taking measurement related to operation of the machine.

14. The hood of claim 3, wherein said second vertical side wall includes at least one transparent portion for maintaining a sight connection with the interior of the hood.

* * * * *